United States Patent [19]

Amdall

[11] 4,010,657

[45] Mar. 8, 1977

[54] BUTTERFLY FOOT PEDAL CONTROL

[75] Inventor: John K. Amdall, Peoria, Ill.

[73] Assignee: Caterpillar Tractor Co., Peoria, Ill.

[22] Filed: Nov. 21, 1975

[21] Appl. No.: 634,019

[52] U.S. Cl. ..... 74/478; 74/474; 74/513

[51] Int. Cl.[2] ..... G05G 9/04; G05G 1/14

[58] Field of Search ..... 74/474, 478, 512, 513; 192/.098

[56] References Cited

UNITED STATES PATENTS

| | | | |
|---|---|---|---|
| 3,262,525 | 7/1966 | Ehlke et al. | 192/13 |
| 3,296,885 | 1/1967 | Peterson | 74/478 |
| 3,691,863 | 9/1972 | Shaffer | 74/478 |
| 3,734,224 | 5/1973 | Franklin | 180/66 R |
| 3,782,488 | 1/1974 | Williamson | 180/6.48 |
| 3,841,423 | 10/1974 | Holtkamp et al. | 180/6.3 |
| 3,858,675 | 1/1975 | Geis | 74/478 X |
| 3,910,133 | 10/1975 | Oestmann | 74/474 X |
| 3,952,512 | 4/1976 | Feller | 74/474 X |

FOREIGN PATENTS OR APPLICATIONS 1,122,511 8/1968 United Kingdom

*Primary Examiner*—Allan D. Herrmann
*Attorney, Agent, or Firm*—Phillips, Moore, Weissenberger, Lempio & Majestic

[57] ABSTRACT

A multifunctional control pedal and linkage arrangement includes a foot pedal mounted for pivotal movement with a lever for throttle control of the vehicle and pivotally mounted for movement with respect to the lever for forward and reverse control of the vehicle with forward and reverse functions obtained by forward and reverse linkages connected to the pedal at opposite sides of the pivotal axis thereof, the linkages each having a locked position and a collapsed position with each connected at one end to the pedal and at the opposite end to opposite sides of a rocker member for transmitting alternate motion to the rocking member upon depression of the foot pedal for transmitting the forward or reverse functional control to the transmission of the vehicle.

6 Claims, 5 Drawing Figures

100°
120°
24
43
53
54
52
51
PIVOT
59
41
45
47

BUTTERFLY FOOT PEDAL CONTROL

BACKGROUND OF THE INVENTION

The present invention relates to control linkages and pertains particularly to a control linkage having a single pedal for coordinated control of throttle and transmission of a vehicle.

Many industrial vehicles, such as lift trucks and the like, require that the vehicle operator perform numerous functions, such as control of implements such as lift forks and the like of the vechicle, at the same time it is controlling forward and reverse and steering of the vehicle. It is, therefore, desirable that the number of control members that require manipulating be reduced as much as possible. Numerous arrangements for combining many of these functions in single controlled members have been proposed in the past.

When such industrial trucks employ hydrostatic transmissions wherein forward and reverse is accomplished by swiveling of the swash plate of the pump of the hydrostatic transmission in one or the other direction about a neutral position, the forward and reverse function of the vehicle can be incorporated in a control which simultaneously controls the engine throttle of the vehicle. One difficulty with incorporating this function; however, is that the forward and reverse of the vehicle must move in opposite directions whereas the control of the throttle linkage must move in a single direction.

Many linkages have been proposed for accomplishing this simultaneous control. However, while many of these are satisfactory in one or more respects they also have drawbacks. For example, many such systems are complicated and expensive to manufacture. Others, while fairly simple and inexpensive to manufacture, require complicated or awkward movement of the operator for accomplishing the necessary or specified controls.

SUMMARY AND OBJECTS OF THE INVENTION

Accordingly, it is the primary object of the present invention to provide a control linkage system that overcomes the above problems of the prior art.

Another object of the present invention is to provide a multifunctional control pedal and linkage arrangement for performing a multiple number of functions by a single control.

A further object of the present invention is to provide a single control pedal with linkage means arranged for a coordinated and simultaneous control of the throttle and the transmission controls of a vehicle.

In accordance with the primary aspect of the present invention, a control pedal and linkage arrangement for coordinated control of the vehicle throttle and transmission includes a control pedal mounted for pivotal movement with a lever for control of the throttle of the vehicle and for pivotal movement about an axis with respect to the lever for controlling linkage means having locked and collapsed positions for transmitting motion for forward and reverse control of the transmission of a vehicle simultaneous with the pedal for throttle control of the vehicle.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
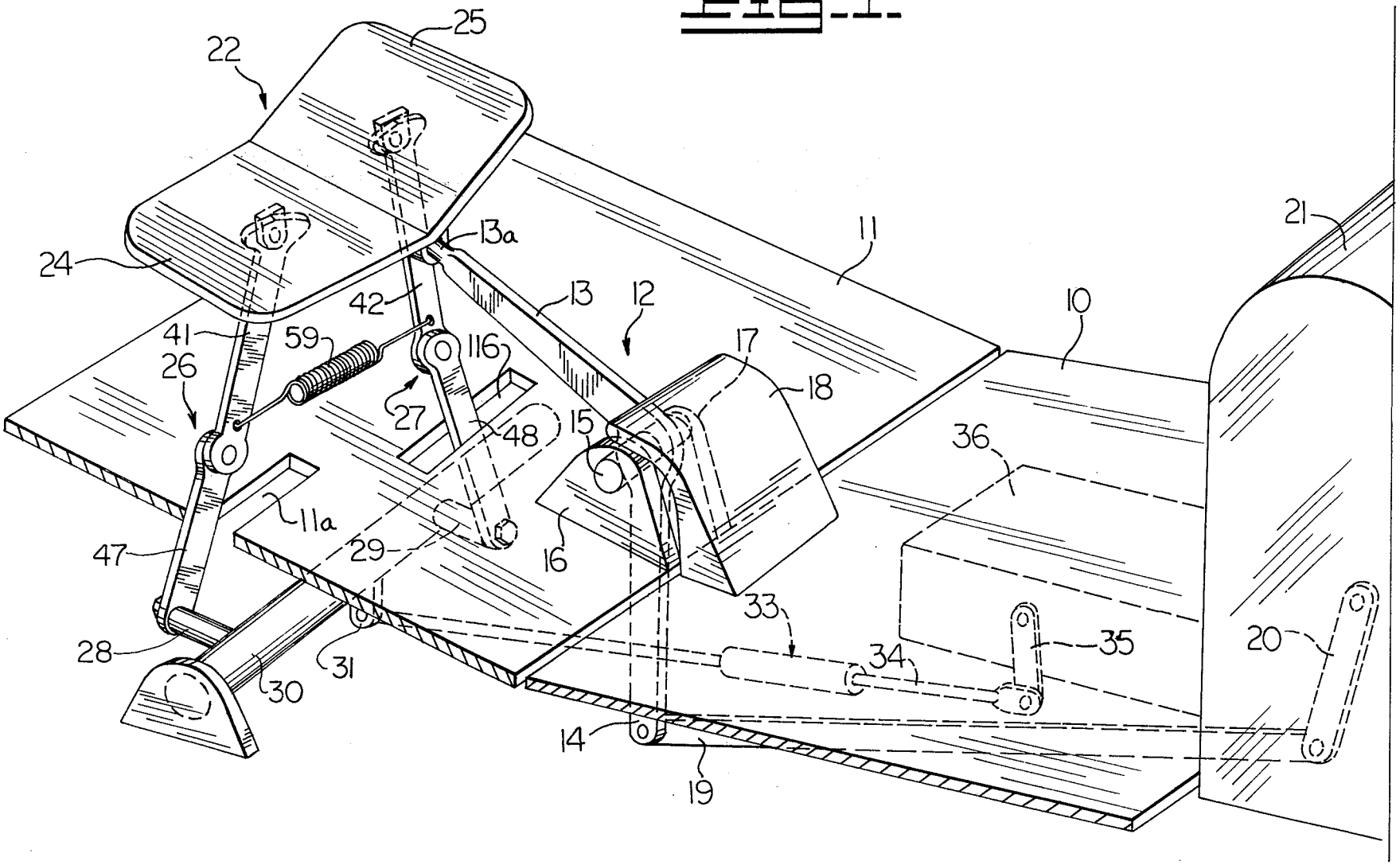
FIG. 1 is a perspective view of a control pedal and linkage system in accordance with the present invention.

Referring now to the drawings with particular reference to FIG. 1, there is generally illustrated the operator station of a vehicle having floor boards 10 and 11. A control linkage, in accordance with the present invention, comprises a lever indicated generally by the numeral 12 having an upper arm 13 and a lower arm 14 that is pivotally mounted about an axis approximate its center by means of a pin or shaft 15 mounted in brackets 16 and 17 secured in a suitable manner such as to the floor board 11. A suitable protective shield or cover 18 is provided over the pivotal mounting arrangement.

The lower lever arm 14 is connected by a suitable link 19 to a throttle arm 20 for controlling the throttle of an engine 21. The arrangement of the throttle linkage is such that pivotal movement of the lever 12 forward moves the lower arm 14 toward the rear for actuation of the throttle to increase the speed of the engine 21 in the usual manner.

Figure 2:
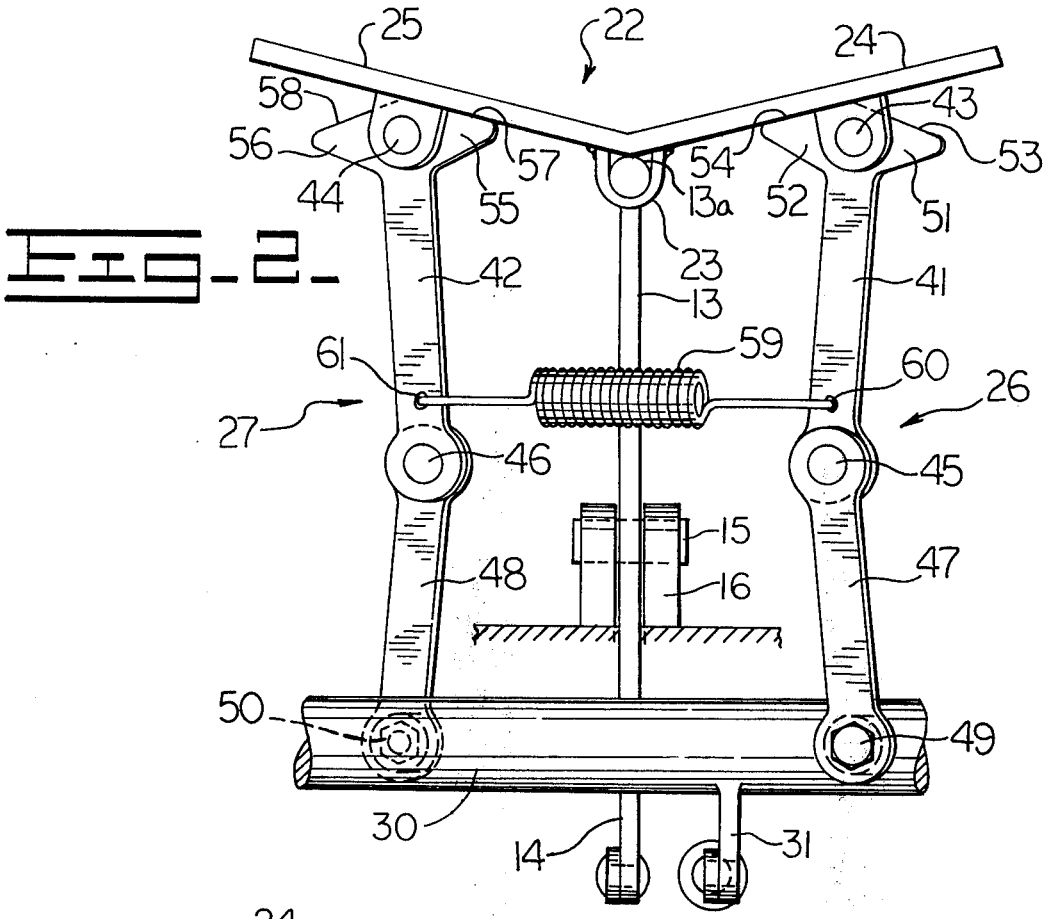
FIG. 2 is a front elevational view of the controlled arrangement of FIG. 1.
Figure 3:
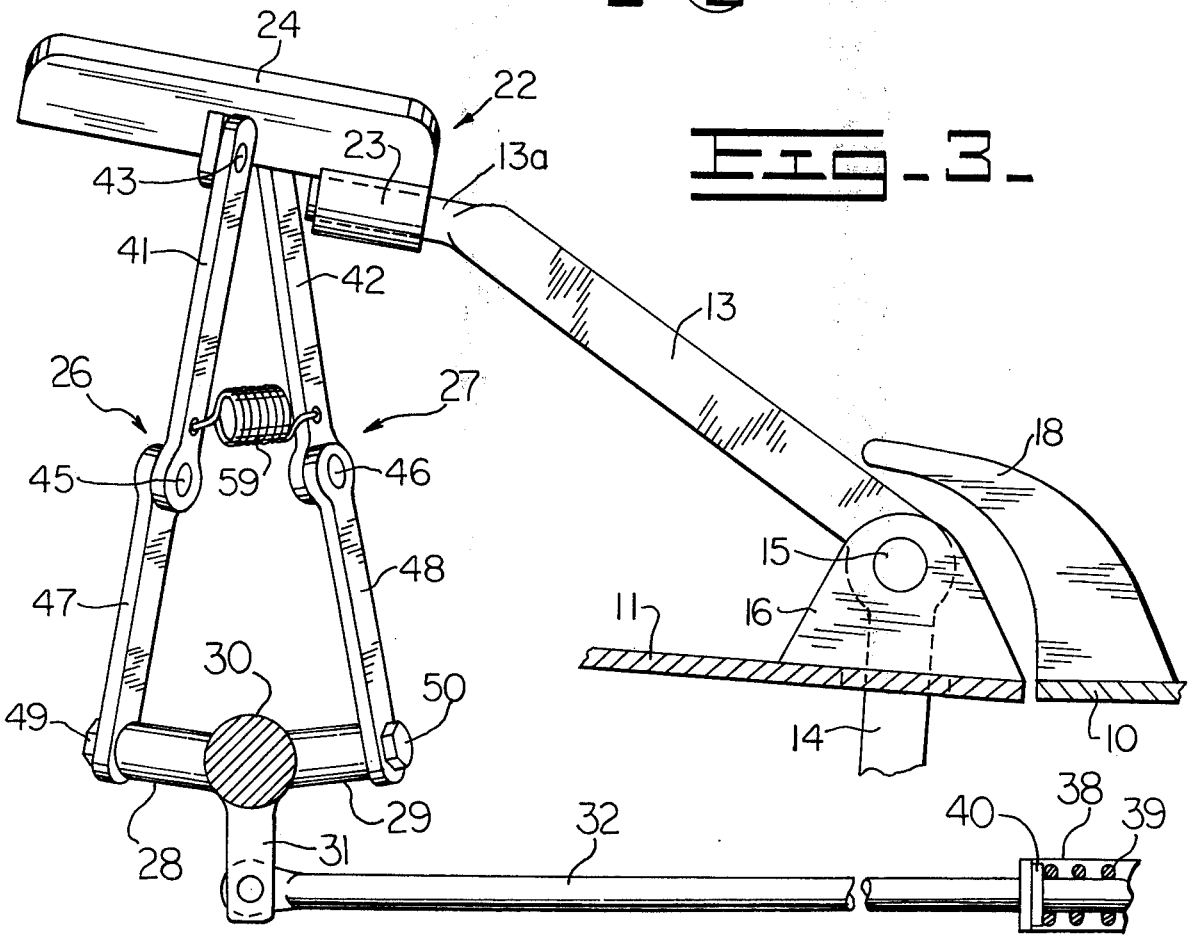
FIG. 3 is a side elevational view of the control linkage of FIG. 1.

Moving now to FIGS. 2 and 3, the upper arm 13 of the lever 12 is illustrated as having an upper cylindrical portion 13A on which is pivotally mounted a foot pedal generally designated by the numeral 22 by means of a somewhat tubular or semitubular member 23 having a central bore for receiving the cylindrical portion 13A of the lever 12. The foot pedal 22 is constructed of a somewhat butterfly configuration having a left side or wing 24 and a right side or wing 25 when viewed in a forward direction as in FIG. 1 with the respective wings intersecting at the center thereof at an angle where the pedal pivots about the arm 13 of lever 12. It is apparent then that the pedal 22 is pivotal about axis 15 of the lever 13 as well as about an axis transverse thereto defined by the cylindrical portion 13A of lever 13.

The pedal 22, as viewed in FIG. 1 in a forward direction, is connected in a suitable manner by left linkage means 26 and right linkage means 27 to opposite disposed arms 28 and 29 of a rocking member or shaft 30. The rocking shaft or member 30 is provided with another arm 31, which is pivotally connected by linkage member 32 which in turn is connected through lost motion linkage means 33 to a link member 34 which in turn is connected to a suitable control arm 35, for controlling a hydrostatic transmission 36. The control arm 35 is connected, in a suitable manner, for controlling the tilt of a swash plate of the hydrostatic transmission 36 in the forward or reverse direction. This swiveling of the swash plate determines the forward or reverse direction or output of the hydrostatic transmission 36 and thus, the direction of the vehicle. The lost motion linkage means 33 is of the usual type, such that movement of control link member 32 transmits force therethrough for movement of member 34 until the member 34 reaches the end of its stroke at which time the lost motion linkage 33 permits the member 32 to continue to move further without further movement of the member 34. Thus, the term "lost motion linkage" as used herein is intended to cover such a link as specifically constructed for such motion and is not intended to cover any linkage having looseness or slack due to wear or manufacturing tolerances. The "lost motion link," for example, as shown in FIG. 3 includes an outer tubular housing 38 connected to one of the links such as 34 with a compression spring 39 confined therein abutting against, for example, one end of the housing 38 and a collar 40 secured to the link member 32 for transmitting force through spring 39 from the link 32 to link 34.

The left and right linkage means 26 and 27 extend through slots or the like 11A and 11B formed in the floor board 11 of the vehicle for transmitting motion from the foot pedal 22 to the rocker member or shaft 30 and thence to the hydrostatic controls of the vehicle.

The linkages 26 and 27 each comprise upper links 41 and 42 pivotally connected at their upper ends at suitable pins or the like 43 and 44 to the respective wings 24 and 25 of the foot pedal 22. The links 41 and 42 are pivotally connected at their lower ends by pins 45 and 46 to the upper ends of lower links 47 and 48, which in turn are pivotally connected respectively at pins or the like 49 and 50 to the respective left and right outwardly extending arms 28 and 29 of the rocking member 30.

The upper link 41 of the left linkage means 26 includes or is provided with a left lobe 51 and a right lobe 52 extending outward therefrom approximate the pivot connection 43 to the left wing 24 of pedal 22. These lobes 51 and 52 each include upper surfaces 53 and 54 each of which are set at approximately a 30° angle to the axis of the link 41 for abutting engagement with the lower surface of the left wing 24 of pedal 22 for limiting the pivotal movement of the link 41 relative thereto. Thus, the link 41 is permitted to pivot to an angle of approximately 30° to either side of an axis extending through pivot 43 at right angles to the surface of the left wing 24. The upper link 42 of the right link means 27 similarly includes a left lobe 55 and a right lobe 56 extending outward therefrom at the pivot connection 44 of the link 42 to the wing 25 of lever or pedal 22. Each of the outwardly extending lobes 55 and 56 include an upper surface 57 and 58 similarly set at an angle of approximately 30° with respect to the link 42 for permitting pivotal movement of the link 42 with respect to the plane of the right wing 25 of pedal 22.

As will be appreciated from the view in FIG. 2, the upward angle of each of the wings 24 and 25 of pedal 22 with respect to a horizontal line is at an angle of less than that of the angle of shoulders 53 and 54, 57 and 58. This permits the linkages 26 and 27 to pivot over center as shown in FIG. 2 such that the pins 45 and 46 are inward from a line passing through upper and lower pins 43, 49 and 44, 50. The above-described angles, of course, are, for example, only and can vary from some degree and still achieve the desired results. The relative angles, however, are critical to the functioning of the device.

The linkage means 26 and 27 define linkage means which have a locked position and a collapsed position as will be described.

Suitable biasing means, such as a tension spring 59 connected such as pivot points 60 and 61 to the respective linkage means 26 and 27, bias the respective linkage means to the over-centered position as shown in FIG. 2. This over-centered position, as will be appreciated, is the locked position of the linkage means. This locked position stiffens the linkages or linkage means 26 and 27 such that downward force on the pedal 22 is tranmitted to the respective arms 28 and 29 of rocking member 30. However, as will be appreciated, since the respective arms 28 and 29 are on opposite sides of the shaft or member 30, downward force on the respective arms attempts to turn the shaft 30 in opposite directions; thus, the respective linkage means 26 and 27 are working against each other and are thus in a locked position.

Figure 4:
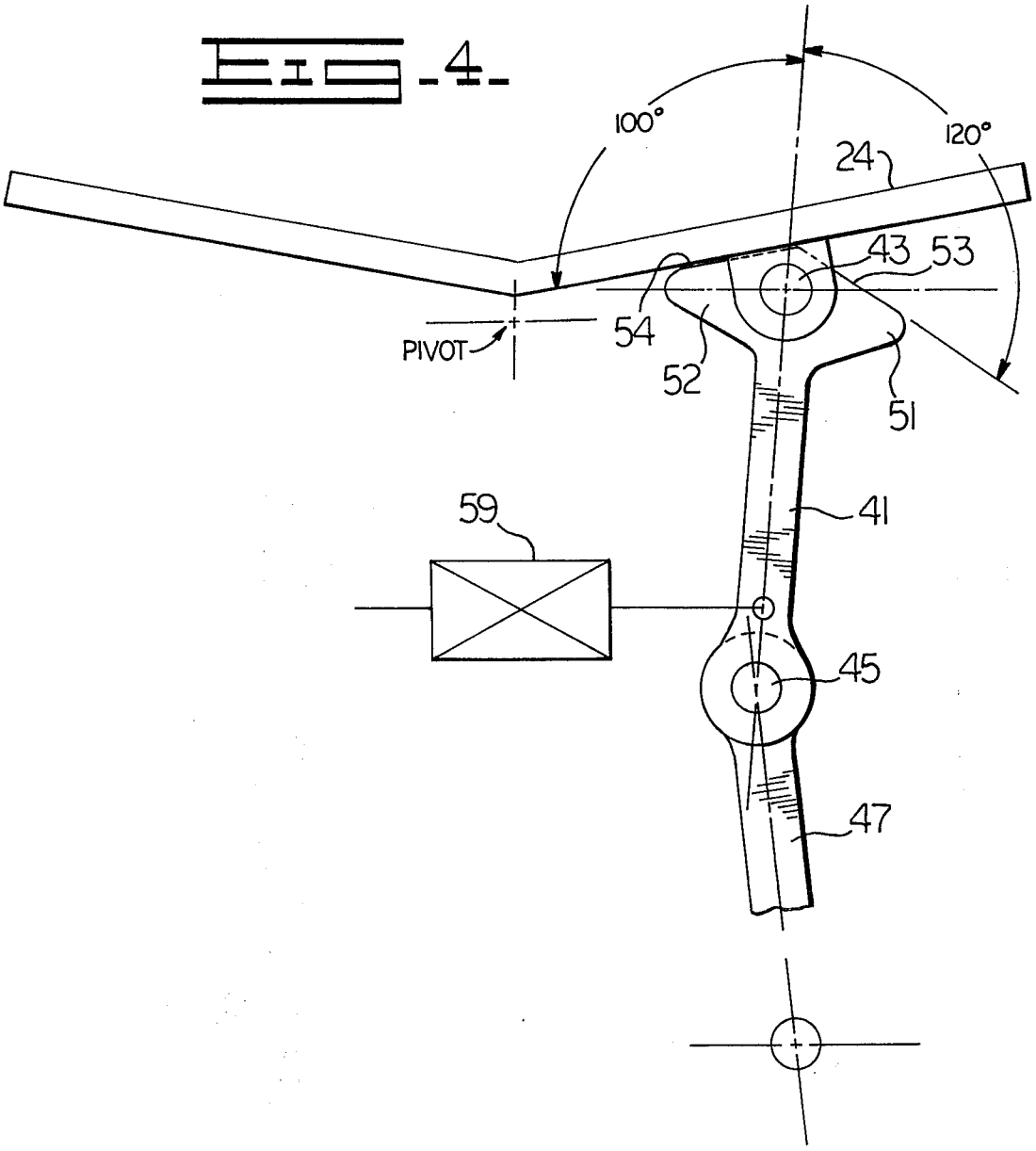
FIG. 4 is an enlarged view of a portion of the control linkage showing the connection of the links to the foot pedal; and, FIG. 5 is a schematic illustration of the position of the links of the apparatus during operation.
Figure 5:
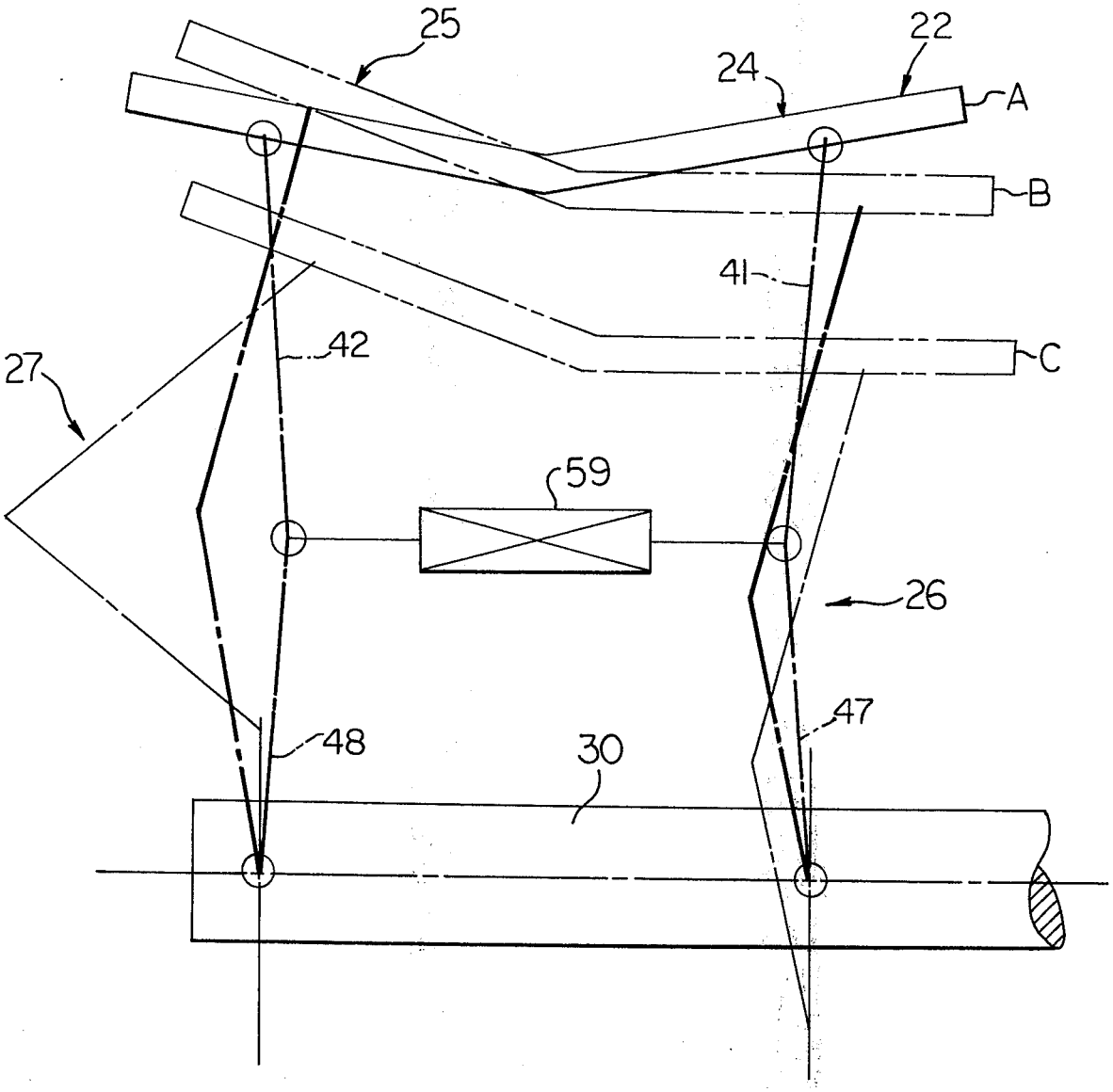

The operation of the linkage of the present invention can best be understood from viewing FIG. 5 wherein consecutive positions of the pedal and linkage are illustrated with the linkage illustrated by center lines only. The progressive positions of the linkage are designated A, B and C respectively with the pedal 22 shown in the neutral or A position with links 41, 47 and 42, 48 illustrated in the locked position A. The B position is illustrated with pedal 22 being tilted over center such that the left wing, right side as viewed in FIG. 4 is tilted down to approximately the level position with the linkage 41, 47 still in the locked position whereas linkage 42, 48 has been forced over center to the B position which is an unlocked position. The C position is then illustrated with the pedal 22 being depressed a considerable amount with linkage 41, 47 in turn shown in the C position as moving downward transferring a motion to the arm 28 of shaft 30 while at the same time linkage 42, 48 collapses as shown in the C position permitting arm 29 of shaft 30 to move upward as shown. This permits the downward movement of pedal 22 to transmit a rotary motion to the shaft 30 to transmit a motion through linkage 32, 33, 34 and 35 to the hydrostatic transmission 36. Thus, if we consider the left linkage 26 to be the forward linkage then the transmission control has been advanced to the forward position for swiveling the swash plate of the pump of the transmission 36 so that the vehicle progressively increases in speed in a forward direction. Simultaneously with the movement of the swash plate of the trasmission 36 to the forward position lever 13 transmits movement through linkage 14, 19 and 20 to the frontal control of the engine 21 and simultaneously therewith increases the speed of the engine of the vehicle.

This provides a simultaneous and coordinated control of the transmission and frontal of the vehicle for simultaneous advancement thereof in the forward direction.

Should the operator wish to move the vehicle in the reverse direction, he simply steps on the opposite wing of the pedal 22 so that the reverse linkage then maintains its locked condition while downward movement of the pedal simultaneously tilting thereof about its axis forces the opposite linkage to collapse to permit movement to be transferred to the opposite arm 29 of the rocker member 30. This motion is then transmitted through the transmission control linkage to the hydrostatic transmission to initiate a reverse direction of the vehicle at the same time that the throttle linkage is advanced to increase the revolutions of the engine of the vehicle.

The system is also preferably provided with the usual creeper pedal (not shown) connected directly or indirectly to the transmission 36 to override the input thereto by means of the linkage 33, 34, and 35. The creeper pedal and/or control permits the throttle to be advanced to a high engine R.P.M. setting with little or no translation movement of the vehicle. In order to achieve this with the present system, the operator depresses the creeper pedal and then depresses either side 24 or 25 of pedal 22. Thus, the throttle linkage is advanced and the input to the transmission is overridden to thereby obtain high R.P.M. of the engine without movement of the vehicle.

While the present invention has been described and illustrated by means of the single embodiment, it is to be understood that numerous changes and modifications may be possible within the scope of the invention as defined in the appended claims.

What is claimed is:

1. A multifunction control pedal and linkage arrangement comprising:

a first lever mounted for pivotal movement about a pivot point and including one end for pivotally supporting a rocker pedal and another end for transmitting motion to an engine throttle linkage;

a rocker pedal pivotally mounted on said one end of said first lever for rocking movement about an axis transverse to the pivot axis of said first lever;

a rocking member mounted for rocking movement about an axis parallel to the pivot axis of said first lever and having an arm extending from each side of the axis thereof;

first linkage means having a locked position and a collapsed position connecting said pedal at one side of the pivot axis of said pedal to one arm of said rocking member; and, second linkage means having a locked position and a collapsed position connecting said pedal at the other side of said axis to the other of said arms, the connection of said first and said second linkage between said pedal and said rocking member being such that said linkages are locked when said pedal is in a centered position and when said pedal is rocked, one side or the other, about the axis thereof one of said linkages is collapsed and the other is locked for transmitting motion to said rocking member.

2. The control linkage arrangement of claim 1 wherein said first and second linkage means each comprises a pair of links, each of said pair of links pinned at one end to each other and each pivotally connected at one end to said pedal and at the other end to one end of said rocker member.

3. The control linkage arrangement of claim 2 including means for limiting pivotal movement of the end of each of said links connected to said pedal.

4. The control linkage of claim 3 comprising means for biasing said first and said second linkage means to said locked position.

5. The control linkage of claim 3 wherein said means for limiting pivotal movement of said linkage comprises a lobe extending outward from one side of said link for engagement with said pedal.

6. The control linkage of claim 3 wherein said means for limiting pivotal movement of said links comprises a lobe extending from each side of each of said links adjacent the pivotal connection of each of said link to said pedal for engagement with said pedal after limited movement of said link with respect to said pedal.

* * * * *